US006579142B1

(12) United States Patent
Rehkemper et al.

(10) Patent No.: US 6,579,142 B1
(45) Date of Patent: Jun. 17, 2003

(54) MODULAR YO-YO

(75) Inventors: Steven Rehkemper, Chicago, IL (US); Todd Hannon, Burlington, WI (US)

(73) Assignee: Rehco, LLC, Chicago, IL (US)

( * ) Notice: Subject to any disclaimer, the term of this patent is extended or adjusted under 35 U.S.C. 154(b) by 0 days.

(21) Appl. No.: 10/237,539

(22) Filed: Sep. 10, 2002

(51) Int. Cl.[7] ..... A63H 1/06
(52) U.S. Cl. ..... 446/247; 446/250
(58) Field of Search ..... 446/247, 236, 446/248, 46, 249–266; 473/588; 273/147

(56) References Cited

U.S. PATENT DOCUMENTS

| | | | | | |
|---|---|---|---|---|---|
| 2,940,212 | A | * | 6/1960 | Bond | |
| 3,643,373 | A | * | 2/1972 | Russell | 46/61 |
| 5,356,328 | A | * | 10/1994 | Ho | 446/242 |
| 5,951,353 | A | * | 9/1999 | Moore | 446/46 |
| 6,123,596 | A | * | 9/2000 | Hsu | 446/250 |
| 6,196,891 | B1 | * | 3/2001 | Jamison | 446/250 |

FOREIGN PATENT DOCUMENTS

JP 11137859 * 5/1999

* cited by examiner

*Primary Examiner*—Jacob K. Ackun
*Assistant Examiner*—Jamila Williams

(57) ABSTRACT

A yo-yo includes a pair of body halves connected to a hub assembly about an axis of rotation. Each body half includes an outer ring positioned between an outside plate and an inside plate, where the inside plate on each body half is positioned to face the hub assembly. The outer ring has an annular projection extending inwardly along an interior surface, and has a lip defined along one edge of the outer ring. The outside plate and inside plate includes grooves that when assembled inside the outer ring form an annular opening about the annular projection. The outside plate also includes a notch defined along one edge of the outside plate and positioned to receive the lip of the outer ring when the outside plate is positioned within the outer ring. The inside plate further has a recess positioned on a surface that faces the hub assembly. The recess has a shape substantially identical to a hub shape defined by a portion of the hub assembly such that when assembled, the portion of the hub assembly is positioned within the recess. The yo-yo being capable of being disassembled such that the outer ring, inside plate, outside plate and hub assembly may be interchangeable with different outer rings with various weights than the original outer ring, as well as replace the inside plate, outside plate and hub assembly.

11 Claims, 3 Drawing Sheets

MODULAR YO-YO

FIELD OF THE INVENTION

The particular invention relates to yo-yos and more particularly to a modular yo-yo that is easily dismantlable such that the yo-yo may be custom designed in both appearance and weight for a particular user.

BACKGROUND OF THE INVENTION

Yo-Yos have been around for many years and are enjoyed by both children and adults. The primary play with yo-yos revolves around mastering tricks, which can be done while the yo-yo is spinning such that when the trick is completed there is still sufficient energy left in the yo-yo to rewind it back into the player's hand. There have been numerous varieties of yo-yos to enhance the performance characteristics as well as enhance the appearance. For example, U.S. Pat. No. D443,530 is directed to a yo-yo watch; U.S. Pat. No. 6,287,193, co-owned by the assignee of the present invention is directed to a yo-yo that includes visual displays and feedback; and there exist yo-yos that glow in the dark.

Dismantlable yo-yos are also known in the art. For example, U.S. Pat. No. 4,207,701 relates to a dismantlable tethered top with reversible halves. The '701 patent distinguishes itself from the present invention in that it is only directed to a yo-yo that may be dismantlable without the use of any tools. This is accomplished by having a center connecting shaft that is threadedly connected to both halves of the yo-yo. The yo-yo is then disassembled by unscrewing one half of the yo-yo in relation to the other half. One problem with this type of dismantlable yo-yo or other threaded axle yo-yos is that they are susceptible to becoming unscrewed during use, which may lead to accidents.

In addition to a dismantlable yo-yo it is also desirable to be capable of changing the weight of the yo-yo because various yo-yo tricks are dependent upon the weight of the yo-yo as well as individual users may desire a lighter or heavier yo-yo. A yo-yo that provides an adjustable weight system may be found in U.S. Pat. No. 6,196,891, which uses sphere shaped weights that attach to a portion of each side member. The '891 patent also distinguishes itself from the present invention in that it states that each sphere has its own center of gravity and is positioned within cavities such that the center of gravity is not on the yo-yo's axis of rotation. This would have a tendency to make the centrifugal forces around the perimeter of the yo-yo different causing the yo-yo to be unbalanced and highly undesirable.

As such there is a need to provide a yo-yo that includes an adjustable weight system that will not cause the yo-yo to be unbalanced. Such a need should further provide for the yo-yo to be modular or dismantlable, thus providing a user with the ability to custom design their yo-yo by interchanging parts with similarly constructed yo-yos. Such a yo-yo allows a user to enhance the performance and permits the user to individualize the yo-yo.

SUMMARY OF THE INVENTION

In accordance with the present invention a yo-yo is provided that includes a pair of body halves connected to a hub assembly about an axis of rotation. Each body half includes an outer ring positioned between an outside plate and an inside plate, where the inside plate on each body half is positioned to face the hub assembly. The outer ring has an annular projection extending inwardly along an interior surface, and has a lip defined along one edge of the outer ring. The outside plate includes a notch defined along one edge of the outside plate and positioned to receive the lip of the outer ring when the outside plate is positioned within the outer ring. The inside plate has a recess positioned on a surface that faces the hub assembly. The recess has a shape substantially identical to a hub shape defined by a portion of the hub assembly such that when assembled, the portion of the hub assembly is positioned within the recess. Both the inside and outside plates include grooves corresponding to the annular projection such that the grooves form an annular opening sized to accommodate the annular projection when the plates are positioned within the outer ring. The yo-yo being capable of being disassembled such that the outer ring, inside plate, outside plate and hub assembly may be interchangeable with another outer ring with a different weight than the original outer ring, another inside plate, another outside plate and another hub assembly. Thus the weight or appearance of the yo-yo may be changed without causing the yo-yo to become unbalanced.

In addition, the yo-yo may be made of a resilient rubber material such that if the yo-yo hits another object it will not be damaged. The resilient rubber material also provides less discomfort to the user, as opposed to a yo-yo manufactured from wood or metal.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein.

DETAILED DESCRIPTION OF THE EMBODIMENTS

Figure 1:
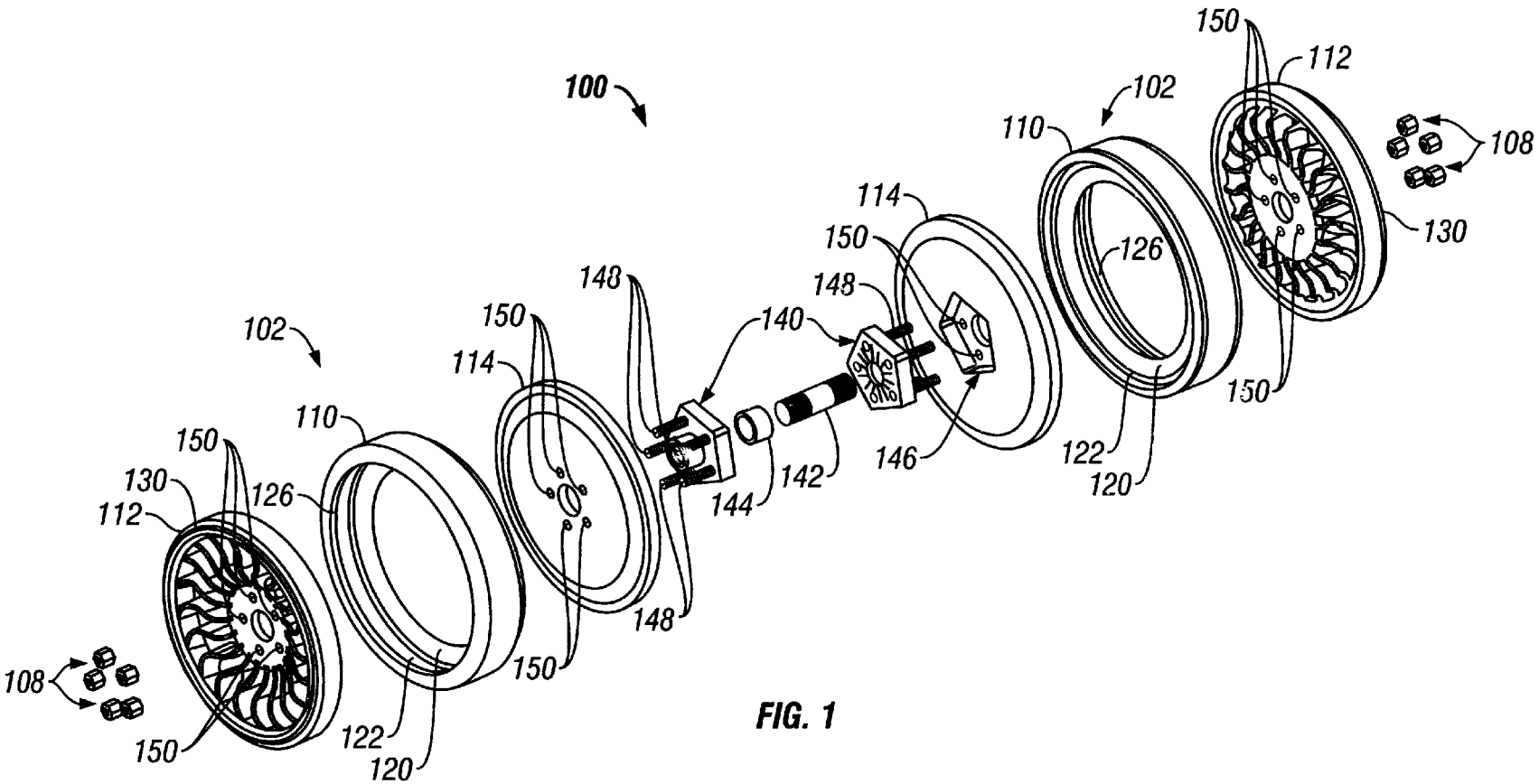
FIG. 1 is an exploded view of a yo-yo in accordance with the present invention.

While the invention is susceptible to embodiments in many different forms, there are shown in the drawings and will be described herein, in detail, the preferred embodiments of the present invention. It should be understood, however, that the present disclosure is to be considered an exemplification of the principles of the invention and is not intended to limit the spirit or scope of the invention and/or claims of the embodiments illustrated.

Figure 2:
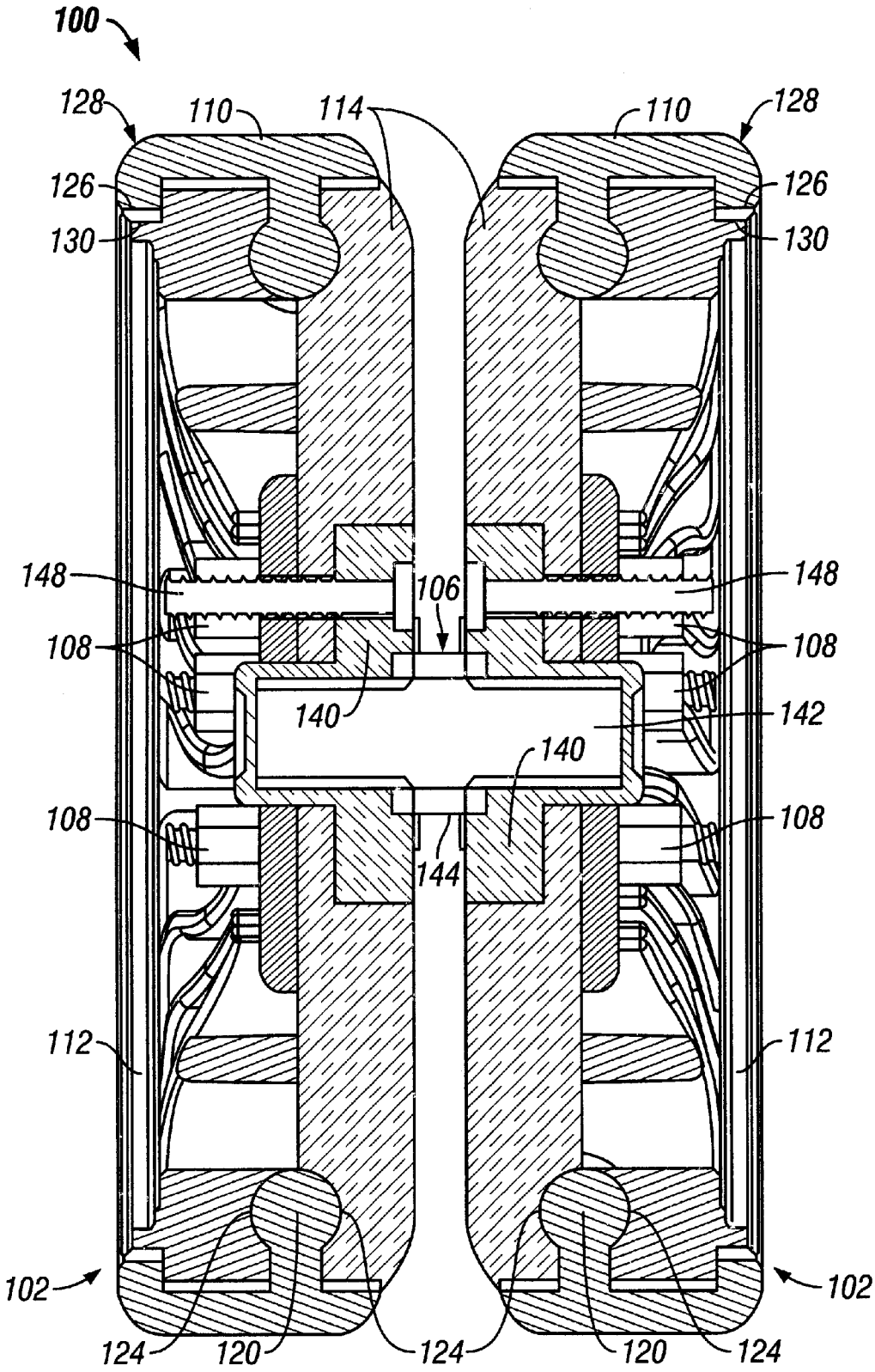
FIG. 2 is a cross sectional view of the yo-yo in accordance with the present invention FIG. 1.
Figure 3:
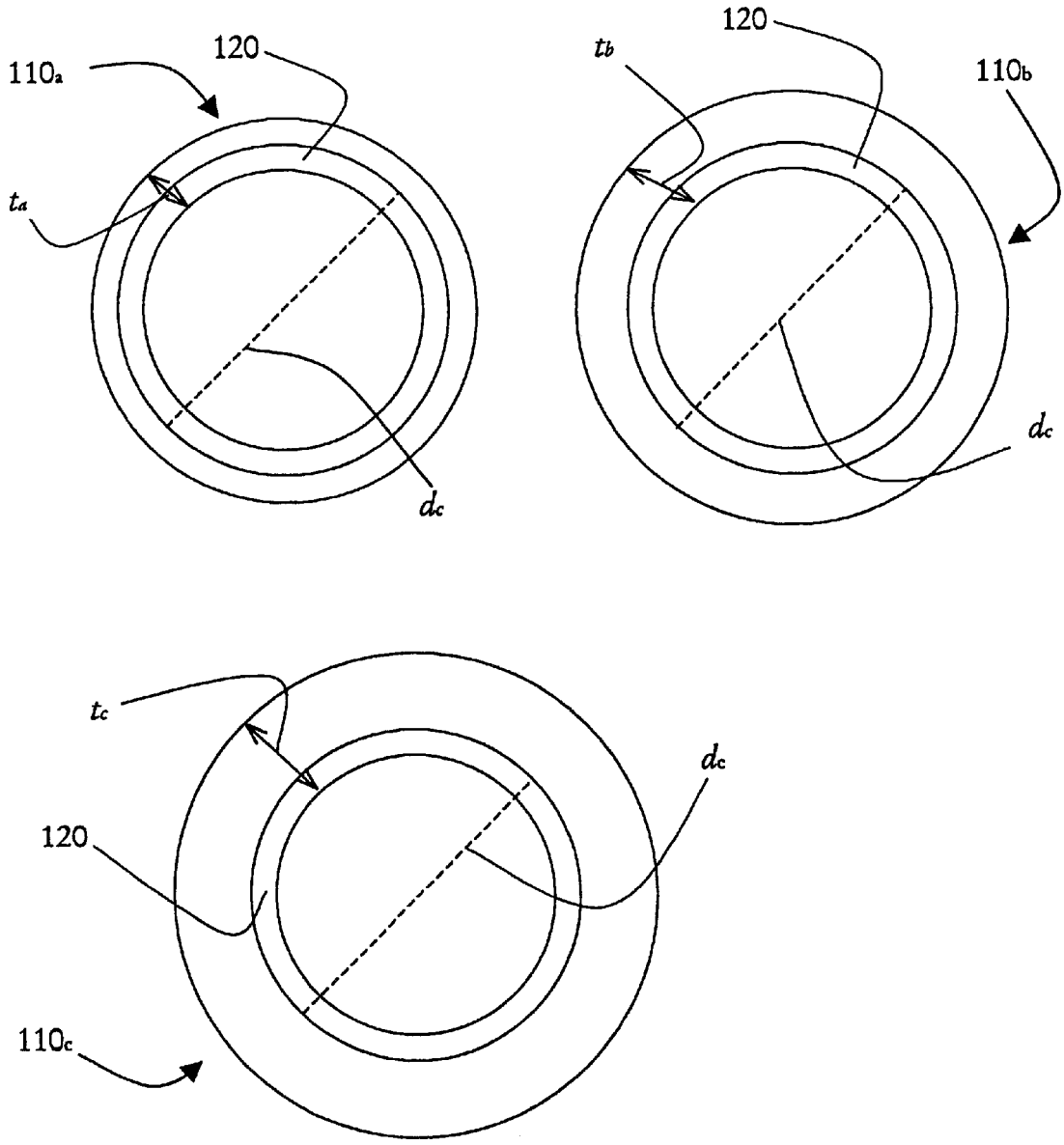
FIG. 3 is a side view of three outer rings, each having a different thickness such that the three outer rings weigh differently, the outer rings are also interchangeable with an outer ring on the yo-yo in accordance with the present invention.

Referring to FIGS. 1 and 2, there is a provided a yo-yo in accordance with the present invention, generally referenced to as 100. The yo-yo 100 includes a pair of body assemblies 102, which are secured to a center hub assembly 106 by a plurality of removable nuts 108.

Each body assembly 102 includes an outer ring 110 that is preferably made from a resilient rubberized material. The rubberized material helps prevent damage to the yo-yo 100, if the yo-yo comes into contact with another object. It further increases user comfort when the yo-yo backs into a user's hand. During use, a yo-yo may be released and returned to a user's hand at a high rate of speed. Since yo-yos are typically made from wood or metal, when a user brings the yo-yo back into their hand, the yo-yo often causes discomfort to the user.

The outer ring 102 is secured between an outside plate 112 and in inside plate 114. Both the outside and inside plates 112 and 114 have diameters that provide a close-fit within the outer ring 110. Thus when the yo-yo 100 is assembled, the plates 112 and 114 will not move around within the outer ring 110, which may cause the yo-yo to become off-balanced.

To ensure the components of the yo-yo form a close-fit well balanced yo-yo, various securing means are employed throughout the present invention. The first such means employed by the present invention is the inclusion of an annular projection 120 protruding inwardly from the interior surface 122 of the outer ring 110, and the inclusion of an annular opening formed by groves 124 on both the outside and inside plates 112 and 114 (FIG. 2). When assembled, the annular projection 120 and annular opening 124 provide a guide such that both the outside and inside plates 112 and 114 are properly positioned with the outer ring 110. As illustrated the annular projection 120 may be bulb shaped, with corresponding shaped grooves 124 on the outside and inside plates 112 and 114. The shape of the annular projection 120 and the grooves 124 however, may be changed without changing the scope of the invention. In addition while it is preferred to employ an annular projection 120 around the entire interior surface 122 of the outer ring 110, it is contemplated by the present invention to incorporate small protrusions extending inwardly from the interior surface 122.

Another means for properly fitting the outside plate 112 with the outer ring 110 is to position a resilient lip 126 along the outer edge 128 of the outer ring 110. The outer edge 128 is further defined as the edge that faces the outer plate 112. The outer plate 112 includes a notch 130 that is positioned to receive the resilient lip 126 of the outer ring 110.

As mentioned above the body assemblies 102 are connected to the hub assembly 106. The hub assembly 106 includes a pair of hubs 140 that are secured to an axle 142. The axle 142 also receives a bearing 144 and string (not shown). The hubs 140 may be threaded onto the axle 142 or pressed fitted. In addition the length of the axle 142 may be such that it extends through the hubs 140 and into and through the inside plate 114 and even partly through the outside plate 112.

Each hub 140 includes a shape that matches a recess 146 defined on the side of the inside plate 114 that faces the hub 140, such that when assembled, the hub 140 securely rests within the recess 146of the inner plate. This provides a smooth interior for the string to wrap around, as it would be undesirable to have the string wrap around the perimeter of the hub 140, as this may cause unwanted slack in the string during use. The hubs 140 also include a plurality of bolts 148 that are received in apertures 150 defined in the inner plate 114 and the outer plate 112 for which the nuts 108 are secured thereto. Moreover, it is within the scope of the present invention to have a single bolt running through body assemblies 102 along the axis of rotation. A pair of nuts 108 secured to the bolt would further secure the body assemblies 102 together.

The present invention provides for an easy means of dismantling a yo-yo and changing the weight of the yo-yo to alter the performance thereof. To disassemble the yo-yo 100 the nuts 108 are unscrewed. A specially designed wrench corresponding specifically to the specifically designed nuts 108 may be provided or the user may use a typical miniature wrench for typical nuts 108. After the nuts 108 are removed, the pair of body assemblies 102 will separate from the hub assembly 106. Each body assembly 102 may be disassembled by prying the resilient lip 126 away from the notch 130 of the outside plate 112. The outside plate 112 may then be removed. In addition, when the body assembly 102 is separated from the hub assembly 102, the inside plate 114 may slide out of the outer ring 102. In addition, the hub assembly 102 may further be disassembled in case the bearing 144 needs to be replaced. Alternatively, the entire hub assembly 102 may be replaced as needed. To assemble a disassembled yo-yo 100, the process is reversed.

Once disassembled, the user may interchange components with other components similarly manufactured. As such, the outside plates 112, inside plates 114, the bearing-144 or the hub assembly 106 may be changed with another outside plate, inside plate, bearing, or hub assembly that has a different design or color. Similarly the outer ring 110 may be changed with other outer rings 110.

It is well known that the performance of the yo-yo is changed when the weight of the yo-yo is changed. To change the weight of the yo-yo 100 in accordance with the presenting invention a plurality of outer rings 110*a*, 110*b* and 110*c* is provided, each with a different thickness ta, tb and tc, respectively. Each outer ring 110 is thus weighted differently. The diameter of the cavity dc of each outer ring 110*a*, 110*b*, and 110*c* remains the same in order to accommodate for the same outside and inside plates 112 and 114. Since the entire outer ring 110 is changed, the center of gravity about the axis of rotation is maintained, thus the centrifugal forces around the yo-yo 100 will also be maintained providing a well balanced yo-yo 100.

From the foregoing and as mentioned above, it will be observed that numerous variations and modifications may be effected without departing from the spirit and scope of the novel concept of the invention. It is to be understood that no limitation with respect to the specific methods and apparatus illustrated herein is intended or should be inferred. It is, of course, intended to cover by the appended claims all such modifications as fall within the scope of the claims.

We claim:

1. A yo-yo comprising:

a pair of body halves each connected to a hub assembly about an axis of rotation;

each body half includes:

an outer ring having an annular projection extending inwardly along an interior surface, and has a lip defined along one edge of the outer ring, an outside plate positioned within the outer ring, the outside plate having a groove along an exterior surface, the outside plate further having a notch defined along one edge of the outside plate and positioned to receive said lip of the outer ring when said outside plate is positioned within the outer ring;

an inside plate positioned within the outer ring and positioned to face the hub assembly, the inside plate having a groove along an exterior surface, the inside plate further has a recess positioned on a surface facing the hub assembly, the recess having a shape substantially identical to a hub shape defined by a portion of the hub assembly such that when assembled said portion of said hub assembly is positioned within said recess;

wherein the grooves of the outside and inside plate form an annular opening sized to accommodate the annular projection on the outer ring when the outside and inside plates are positioned within the outer ring and the hub assembly includes an axle, a bearing positioned on said axle, and a pair of hubs separately positioned on said axle on either side of the bearing, each hub having said hub shape and at least one bolt positioned towards and through the inside and outside plate.

2. The yo-yo of claim 1 further comprising:

at least one bolt positioned through said outer plates of each body half and a pair of corresponding nuts removably secured to said bolt, whereby when said removable nuts are removed, the body halves separate from each other.

3. The yo-yo of claim 1 wherein the outer rings on each body half is interchangeable with a pair of differently weighted outer rings, whereby the outer rings may be removed and replaced with said differently weighted outer rings, when the yo-yo is disassembled.

4. The yo-yo of claim 1 wherein the outer ring is made of a resilient material.

5. A modular yo-yo comprising:

a pair of body halves each connected to a hub assembly about an axis of rotation;

at least two bolts separately extending away from said hub assembly towards and through each body half;

a removable nut corresponding to each bolt;

each body half includes:

a resilient outer ring having an annular projection extending inwardly along an interior surface, and has a lip defined along one edge of the outer ring, an outside plate positioned within the outer ring, the outside plate having a groove along an exterior surface, the outside plate further having a notch defined along one edge of the outside plate and positioned to receive said lip of the outer ring when said outside plate is positioned within the outer ring;

an inside plate positioned within the outer ring and positioned to face the hub assembly, the inside plate having a groove along an exterior surface, the inside plate further has a recess positioned on a surface facing the hub assembly, the recess having a shape substantially identical to a hub shape defined by a portion of the hub assembly such that when assembled said portion of said hub assembly is positioned within said recess, and wherein the grooves of the outside and inside plate form an annular opening sized to accommodate the annular projection on the outer ring when the outside and inside plates are positioned within the outer ring; and wherein when the removable nuts are removed, the outer rings of the body halves may be interchangeable with a differently weighted outer rings, and the inside plates, outside plates and the hub assembly may be interchangeable with differently designed but similarly configured inside plates, outside plates and hub assemblies.

6. The yo-yo of claim 5, wherein each hub assembly includes:

an axle;

a bearing positioned on said axle; and a pair of hubs separately positioned on said axle on either side of the bearing, each hub having said hub shape and at least one bolt positioned towards and through the inside and outside plate.

7. A modular yo comprising:

a pair of body halves each connected to a hub assembly about an axis of rotation;

each body half includes:

an outer ring having an annular projection extending inwardly towards the center of said outer ring, an outside plate positioned within the outer ring, the outside plate having a groove along an exterior surface, an inside plate positioned within the outer ring and positioned to receive the hub assembly, the inside plate having a groove along an exterior surface, wherein the grooves of the outside and inside plate form an annular opening sized to accommodate the annular projection on the outer ring when the outside and inside plates are positioned within the outer ring such that the outside plate and inside plate capture the outer ring in when assembled.

8. The modular yo-yo of claim 7, wherein:

the outer ring further includes a lip along an edge of the outer ring; and the outside plate further having a notch defined along one edge of the outside plate and positioned to receive said lip of the outer ring when said outside plate is positioned within the outer ring such that the outside plate is secured within the outer ring.

9. The modular yo-yo of claim 7, wherein the inside plate further has a recess positioned on a surface facing the hub assembly, the recess having a shape substantially identical to a hub shape defined by a portion of the hub assembly such that when assembled said portion of said hub assembly is positioned within said recess.

10. The modular yo-yo of claim 7, wherein the hub assembly includes an axle, a bearing positioned on said axle, and a pair of hubs separately positioned on said axle on either side of the bearing, each hub having said hub shape and at least one bolt positioned towards and through the inside and outside plate.

11. The yo-yo of claim 1 wherein the outer ring is made of a resilient rubber material.

* * * * *